US009734743B2

(12) United States Patent
Levinsohn

(10) Patent No.: US 9,734,743 B2
(45) Date of Patent: Aug. 15, 2017

(54) MICROPHONE ACCESSORY, A METHOD OF USING A MICROPHONE, AND A MICROPHONE

(71) Applicant: Steven Mark Levinsohn, Johannesburg (ZA)

(72) Inventor: Steven Mark Levinsohn, Johannesburg (ZA)

( * ) Notice: Subject to any disclaimer, the term of this patent is extended or adjusted under 35 U.S.C. 154(b) by 11 days.

(21) Appl. No.: 14/856,625

(22) Filed: Sep. 17, 2015

(65) Prior Publication Data

US 2016/0005341 A1 Jan. 7, 2016

(30) Foreign Application Priority Data

Sep. 17, 2014 (ZA) ..... 2014/06797

(51) Int. Cl.
*G09F 23/04* (2006.01)
*H04R 1/08* (2006.01)
*H04R 1/02* (2006.01)

(52) U.S. Cl.
CPC ..... *G09F 23/04* (2013.01); *H04R 1/08* (2013.01); *H04R 1/028* (2013.01); *H04R 2420/07* (2013.01); *H04R 2499/15* (2013.01)

(58) Field of Classification Search
CPC ..... G09F 23/04
USPC ..... 84/379; 132/238; 320/114; 348/14.1; 381/91, 361, 388, 362; 434/307 A; 455/66.1; 705/1.1; 360/137
See application file for complete search history.

(56) References Cited

U.S. PATENT DOCUMENTS 3,604,853 A * 9/1971 Pless ..... H04R 1/083 235/87 R
4,527,019 A * 7/1985 Lemp ..... H04R 1/08 248/324
5,808,663 A * 9/1998 Okaya ..... H04N 7/142 348/14.1
6,520,776 B1 * 2/2003 Furukawa ..... G10H 1/361 341/176
6,548,987 B1 * 4/2003 Oster ..... H04R 1/08 320/114
7,103,318 B2 * 9/2006 Levinsohn ..... G09F 19/00 455/41.2
2003/0224732 A1 * 12/2003 Suzuki ..... H04R 1/083 455/66.1
2007/0175313 A1 * 8/2007 Vandervliet ..... H04R 1/08 84/379

(Continued)

*Primary Examiner* — Gerald Gauthier

(57) ABSTRACT

The invention relates to microphone accessories, methods of using microphones, and a microphone. The accessory has at least one body having at least one display face for displaying at least one communication; an attachment formation for operatively attaching all or part of the accessory to the microphone; and a displacement arrangement controllable to displace all or part of the accessory automatically in a pre-determined or pre-selected manner relative to the microphone such that, in use, the at least one display face is correspondingly automatically displaced rotatably relative to the microphone. The invention also extends to an associates method of using a microphone by providing an accessory on a microphone flag and displacing the same relative to the microphone. Moreover, the invention extends to a microphone operable to displace a microphone accessory relative to a longitudinal axis of a handle thereof.

20 Claims, 4 Drawing Sheets

(56) References Cited

U.S. PATENT DOCUMENTS

| | | | | |
|---|---|---|---|---|
| 2007/0277843 | A1* | 12/2007 | Whitman | A45D 6/045 132/238 |
| 2008/0205684 | A1* | 8/2008 | Wilson | H04R 1/08 381/388 |
| 2011/0054922 | A1* | 3/2011 | Gaines | G06Q 30/02 705/1.1 |
| 2015/0098602 | A1* | 4/2015 | Levinsohn | G09F 23/00 381/361 |
| 2015/0124996 | A1* | 5/2015 | Levinsohn | H04R 1/08 381/91 |
| 2016/0005341 | A1* | 1/2016 | Levinsohn | G09F 23/04 381/91 |

* cited by examiner

MICROPHONE ACCESSORY, A METHOD OF USING A MICROPHONE, AND A MICROPHONE

FIELD OF THE INVENTION

The invention relates to microphone accessories, methods of using microphones, and a microphone.

BACKGROUND OF THE INVENTION

Microphone flags are attached to microphones to display a message to an audience, in person, or primarily when the microphone flag is filmed and displayed to an audience of viewers.

It is advantageous for the microphone flag to display more than one message or advertisement and/or provide one or more advertisements so as at least to increase visibility and marketing revenue.

It is an object of the invention to at least provide an alternate advertising means.

SUMMARY OF THE INVENTION

According to a first aspect of the invention, there is provided a microphone accessory for use with a microphone, the microphone accessory comprising:

at least one body having at least one display face for displaying at least one communication;

an attachment formation for operatively attaching all or part of the accessory to the microphone; and a displacement arrangement controllable to displace all or part of the accessory automatically in a pre-determined or pre-selected manner relative to the microphone such that, in use, the at least one display face is correspondingly automatically displaced relative to the microphone.

It will be understood that all or part of the microphone accessory may be the entire accessory relative to the microphone and at least one body comprising the at least one display relative to the microphone, respectively. In other words the part of the accessory referred to may be the body, and associated components.

The attachment formation may be in the form of a central bore extending through the accessory, wherein one, or both, of a head portion, and handle of the microphone is receivable therein, and wherein the at least one body or the accessory is rotatably displaceable about an axis of the central bore, in use.

The displacement arrangement may comprise:

a wired or wireless actuator; and a wired or wireless controller, wherein wired or wireless operation of the actuator causes the controller to generate a wired or wireless control signal in a predetermined or pre-selected fashion so as to cause operative displacement of the at least one body or accessory.

The displacement arrangement may comprise:

at least one roller member mountable to the at least one body and rotatable about an axis substantially parallel to the axis of the central bore, wherein the roller member is at least partly disposed in the central bore so as to frictionally engage the head portion or handle of the microphone disposed in said central bore; and a motor operatively coupled to the at least one roller member, wherein the motor is actuable, in response to receiving a suitable control signal, to cause rotation of the at least one roller member so as to cause displacement of the accessory around the head portion or handle of the microphone, in use.

The accessory may comprise an internal frame attachable to one, or both, of the head portion and handle of the microphone, wherein the at least one body is mountable to the internal frame and is operatively displaceable relative thereto, wherein both the at least one body and the internal frame define the central bore therethrough; and wherein the displacement arrangement is operable to displace the at least one body relative to the internal frame about the axis of the central bore.

The displacement arrangement may comprise:

at least one rotator attachable to the at least one body, wherein the rotator shares an axis with the central bore and is operatively rotatable about said axis; and a motor operatively mountable to the internal frame and operatively coupled to the at least one rotator, wherein the motor is actuable, in response to receiving a suitable control signal, to cause rotation of the at least one rotator so as to cause displacement of the at least one body relative to the internal frame, in use.

The accessory may comprise:

one or more additional bodies, having one or more additional display faces, wherein the one or more additional bodies are one or more of being operatively attachable to the displacement arrangement so as to be rotatably displaceable thereby, operatively attachable to the at least one body so as to be rotatably displaceable by the rotation of the at least one body, and fixedly attachable to the internal frame such that the one or more additional bodies is not displaceable, in use.

The one or more additional bodies may be spaced from the at least one body albeit operatively attachable to in certain example embodiments. The additional bodies may also have bores for receipt of the microphone head and/or handle therein. Differently defined, the at least one body may be a first body and the one or more additional bodies may be second, third, fourth bodies, etc. In some example embodiments, the displacement arrangement may be located in a secondary or second body fixedly connected to the microphone in a removable fashion, wherein the displacement arrangement may comprise turntable rotatable relative to the secondary body and about a central bore of the second body, as well as a longitudinal axis of the microphone, in use, and wherein the at least one body, or first body, may be attachable to said turntable thereby causing the rotation of the first body relative to the second body and the microphone, in use. In this example embodiment, the first body may be spaced from the second body by suitable spacers and may comprise a bore having the same axis as the bore of the second body.

In some further example embodiments, it will be noted that a first body may rotate relative to the microphone in the fashion described above, and a second body may be spaced from and attachable thereto by way of suitable spacers so as to also be displaced on displacement of the first body.

The internal frame may comprise or is removably attachable to a handle receiver portion, wherein the handle receiver portion shares an axis with the central bore and is shaped and/or dimensioned to receive a handle of the microphone therethrough, in use.

The accessory may comprise one or more of:

the at least one display face displaying at least one static non-electronically variable communication;

the at least one display face comprising a display screen suitable for displaying an electronically variable communication;

at least one static display removably attachable to the at least one display face, wherein the static display is configured to display at least one static non-electronically variable communication; and at least one dynamic display removably attachable to the at least one display face, the dynamic display comprising at least one display screen suitable for displaying an electronically variable communication.

The static non-electronically variable communication may be selected from the group comprising printed media, two-dimensional objects, and three-dimensional object.

The at least one body shape may be selected from the group comprising a cuboidal shape, having four planar surfaces each defining a display face a triangular shape having three planar surfaces each defining a display face, and an annular shape having a single curved surface defining a single curved display face.

According to a second aspect of the invention, there is provided a method of using a microphone, the method comprising:

locating a microphone accessory on a microphone, wherein the microphone accessory comprises at least one body having at least one display face for displaying at least one communication; and an attachment formation for operatively attaching the at least one body to the microphone; and displacing all or part of the accessory in pre-determined or pre-selected automatic fashion relative to the microphone.

It will be noted that displacing the accessory may comprise controlling a displacement arrangement, by wire or wirelessly, associated with the accessory and/or the microphone, to displace the accessory or the at least one body.

The attachment formation may be in the form of a central bore through the accessory through which one, or both, of a head and a handle of a microphone is receivable, the method comprises controlling the displacement arrangement to displace the accessory or the at least one body rotatably around an axis of the central bore.

The displacement arrangement may comprise at least one roller member mountable to the at least one body and rotatable about an axis substantially parallel to the axis of the central bore, wherein the roller member is at least partly disposed in the central bore so as to frictionally engage the head portion or handle of the microphone disposed in said central bore; and a motor operatively coupled to the at least one roller member, wherein the motor is actuable, in response to receiving a suitable control signal, to cause rotation of the at least one roller member, the method may thus comprise receiving a suitable control signal and controlling the motor to rotate the at least one roller member so as to displace the accessory around the head portion or handle of the microphone.

The microphone accessory may comprise an internal frame attachable to one, or both, of the head portion and handle of the microphone, wherein the at least one body is mountable to the internal frame and is operatively displaceable relative thereto, wherein both the at least one body and the internal frame define the central bore therethrough; wherein the method may comprise controlling the displacement arrangement to displace the at least one body relative to the internal frame about the axis of the central bore.

The at least one display face displays at least one static non-electronically variable communication, and/or comprises a display screen suitable for displaying an electronically variable communication; and/or wherein the accessory comprises a display removably attachable to the at least one display face, wherein the display may configured to display at least one static non-electronically variable communication, and/or the removably attachable display comprises at least one display screen suitable for displaying an electronically variable communication.

According to a third aspect of the invention, there is provided a microphone comprising:

a microphone head portion comprising a suitable transducer and associated circuitry; and a handle comprising a displacement arrangement engageable with a microphone accessory, at least one body having at least one display face for displaying at least one communication; and an attachment formation for operatively attaching the at least one body to the displacement arrangement of the handle, wherein the displacement arrangement is controllable to displace the at least one body of the accessory, or the accessory, automatically in a pre-determined or pre-selected manner relative to a longitudinal axis of the microphone handle, in use.

The attachment formation may in the form of a central bore extending through the accessory, wherein the handle of the microphone is receivable therein, and wherein the displacement arrangement may comprise:

at least one roller member mountable to the handle rotatable about an axis substantially parallel to the longitudinal axis of the handle; and a motor operatively coupled to the at least one roller member, wherein the motor is actuable, in response to receiving a suitable control signal, to cause rotation of the at least one roller member, wherein the roller member at least partly protrudes from the handle so as to engage the accessory in the central bore, in use, such that operation of the motor causes the at least one roller member to be actuated so as to frictionally engage the accessory within the central bore and cause rotational displacement of the accessory around the handle of the microphone.

The attachment formation may be in the form of a central bore extending through the accessory, wherein the handle of the microphone is receivable therein, wherein the accessory may comprise an internal frame attachable to the handle adjacent the displacement arrangement, wherein the at least one body of the accessory is mountable to the internal frame and is operatively displaceable relative thereto, wherein the both the at least one body and the internal frame define the central bore therethrough; wherein the displacement arrangement may comprise:

at least one rotator attachable to the at least one body of the accessory, wherein the rotator shares an axis with the longitudinal axis of the handle and is operatively rotatable about said longitudinal axis; and a motor and operatively coupled to the at least one rotator, wherein the motor is actuable, in response to receiving a suitable control signal, to cause rotation of the at least one rotator so as to cause displacement of the at least one body relative to the internal frame and the longitudinal axis of the microphone, in use.

It will be understood that the displacement arrangement of the microphone may be substantially similar to that described above so as to displace the accessory.

DESCRIPTION OF THE INVENTION

Figure 1A:
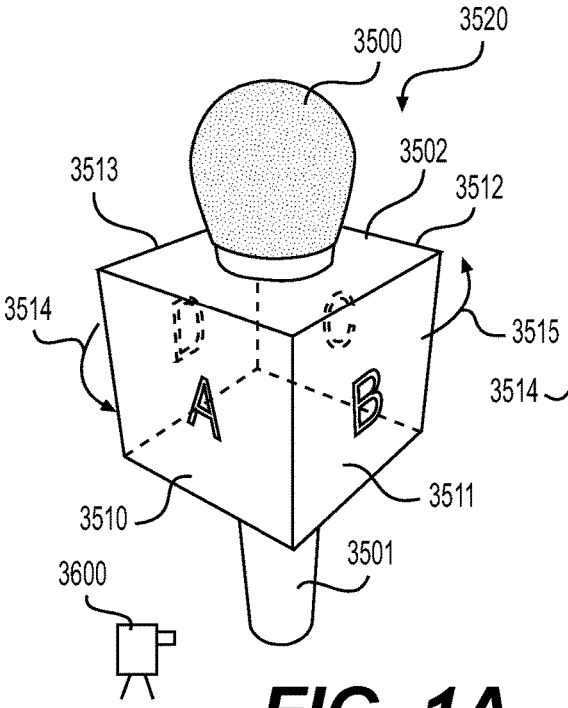
FIG. 1A illustrates a perspective view of an accessory in accordance with an example embodiment of the invention prior to rotation.

The term "communication" as used herein means any indicia, marks, advertising, logo, coupon, promotional message, message, communication, idea, brand, trade mark, trade name, intellectual property right, symbol, digit, letter, word, symbol sets, representations and or any other physical form or forms representing information, whether permanent or temporary.

A communication may be an electronic communication displayed using an electronic display device and/or a communication may be a non-electronic or static communication.

A static communication may be displayed using a material such as paper, cardboard, plastic, vinyl, a wall, a painted surface, rubber, print, magnetic paper, and or any combination of the preceding and or any other suitable material/s.

A static communication may be removably or permanently attached to a surface of material and or to the microphone accessory.

A removable static communication may be attached to a surface by a plurality of means, including by adhesive, pressure, friction, male-female attachment means, clips, magnets, magnetic paper, magnetic plastic or rubber and so on.

The term "transmitter" or "transmitted" as used herein means any device which transmits, radiates or distributes a signal, whether optical, video, filmed, radar, sonar, ultrasound, visual, infrared, acoustic, electric, magnetic, electromagnetic or otherwise manifested, whether digital and or analogue or otherwise manifested.

The term "receiver" or "received" as used herein means any device which acquires and or captures a signal(s) and or image(s) or a series of images (such as video images), whether visual, optical, radar, sonar, infrared, filmed, ultrasound, acoustic, electric, magnetic, electromagnetic or otherwise manifested, whether digital and or analogue or otherwise manifested. The receiver may use a photographic lens and associated imaging device(s) to capture images including images of vehicles and or people.

When used in appropriate context the term "device" means any transmitter and/or receiver. A device and/or display means may include an electronic display device configured to display at least one image or a plurality of images, and includes the necessary software, hardware, circuitry, power supply, data, data bases, input means, transmission and/or reception means, interface, and so on to display and/or use the identified data, a static display means including a display surface on which a communication may be displayed, directly or indirectly, by various suitable means including by printing onto the surface of the static display means and/or by attaching a second display means (such as paper with a communication displayed thereon to the surface of the display means using a suitable attachment means such as an adhesive) and/or by the display of at least one communication using an electro-mechanical display means, or other suitable communication display means. In addition, the term device refers to the type of device and/or display means described. A device may include an electronically variable means comprising at least one light or illumination source or a plurality of illumination sources. A device may comprise a plurality of laser beams (not illustrated). A device may display and/or project at least one communication (variable and/or static) as a 2D image or communication and/or a 3D image or communication and/or a holographic image or communication.

The term "image" includes a single image or a series of images, whether digital or analogue, whether on film or video or using other suitable means, whether 2 dimensional and/or 3 dimensional and/or holographic.

In this specification "to film" or to "video" means to capture an image, or a sequence of images, in a suitable manner, including chemical, magnetic or optical, and either in analogue or digital form; and "filming" and "film" or "videod" and "video" (as a verb) have corresponding meanings. The filming or videoing of an image or a sequence of images may be achieved and or recorded by a camera. A camera includes recording the image of an object on a light-sensitive material or by a camera which is an electronic device for capturing images and converting them into electrical impulses (analogue and or digital) or by other suitable means.

The terms "coupled", "coupled to" and "coupled with" as used herein means a relationship between or among two or more devices, any means described herein, the accessory/ies described herein, apparatus, files, programs, media, components, materials, networks, systems, subsystems and or means, comprising any one or more of (a) a connection and/or attachment whether direct or indirect, permanent or removable, or through one or more other devices, apparatus, files, cables, wireless, programs, media, components, networks, systems, sub-systems or means, magnet, adhesive, friction, male-female coupling, clip, velcro, means of attachment, means of connection (b) a communications relationship, whether direct or indirect or through one or more other devices, apparatus, files, programs, media, components, networks, systems, sub-systems or means, or (c) a functional relationship in which the operation of any one or more thereof depends, in whole or in part, of the operation of any one or more others thereof.

The term "processor" and or "processing" and or "controller" and or "controlling" as used herein means processing device(s), apparatus, programs, circuits, data, data bases, sensor/s, power supply, systems and sub-systems, whether implemented in hardware, software, circuitry or any combination thereof, and whether for processing analogue and/or digital data.

The term "data" as used herein means any indicia, signals, information, marks, binary data, symbols, digits, letters, words, domains, symbol sets, digital data, analogue data, representations and any other physical form or forms representing information, whether permanent or temporary, whether visible, audible, acoustic, electric, magnetic, electromagnetic, infrared, binary, radar, laser, optical or otherwise manifested. The term "data" as used herein to represent certain information in one physical form shall be deemed to encompass any and all representations of the same information in a different form or forms.

As illustrated in FIG. 1A, microphone accessory 3502 may be attached, removably or permanently, to handle 3501 of microphone 3500. Microphone accessory 3502 may be attached, permanently or removably, to a microphone or non-microphone holder, stem, stalk, handle, extender, stand, coupler and so on. Microphone accessory 3502 may display at least one communication 3510 on at least one side. Using electrical and/or electronic and/or electromechanical and/or mechanical means, microphone accessory 3502 may, in use, rotate about microphone handle 3501, at the rotation speed selected by the user thereof and/or may stop/start rotating and remain in a stationary position for a period of time selected by the user thereof.

For example, as illustrated in FIG. 1A, microphone accessory 3502 may have a cuboidal body and may display communication A on side, or in other words display face, 3510 and/or communication B on side/display face 3511 and/or communication C on side/display face 3512 and/or communication D on side/display face 3513. Using an electromechanical arrangement (not illustrated), when activated according the input/s of the user, microphone flag accessory 3502 and/or the faces 3510, 3511, 3512, 3513 may rotate in the direction as indicated by arrows 3514 and 3515, or in the opposite direction as the case may be in response to a control signal received. Camera 3600 may film accessory 3502 and may film and/or transmit front facing side 3510 which displays communication A to an audience of viewers.

Figure 1B:
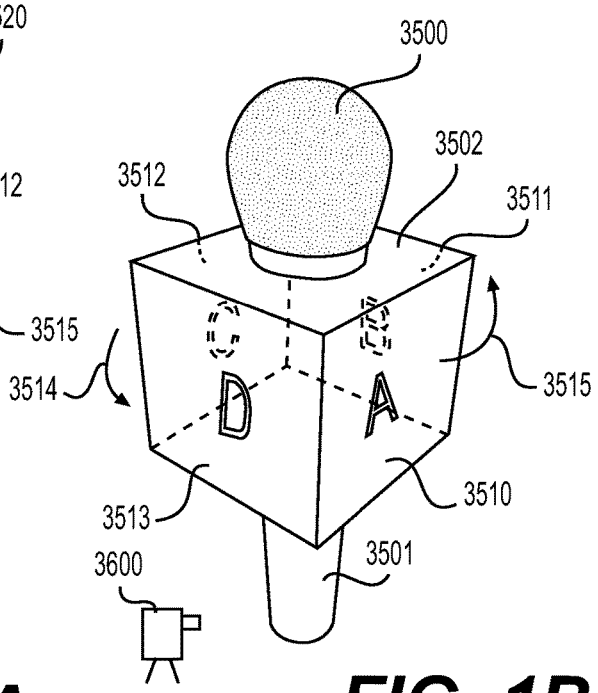
FIG. 1B illustrates a perspective view of an accessory in accordance with an example embodiment of the invention post rotation.

Once rotated, as illustrated in FIG. 1B, side 3510 which displays communication A has moved to the position formerly occupied by side 3511 which displays communication B, side 3511 which displays communication B has moved to the position formerly occupied by side 3512 which displays communication C, side 3512 which displays communication C has moved to the position formerly occupied by side 3513 which displays communication D and side 3513 which displays communication D has moved to the position formerly occupied by side 3510 which displays communication A. Camera 3600 may film the rotation of the accessory 3502, in whole or in part, for as many rotations or part thereof as desired, and may transmit such filming to an audience of viewers. Significantly, the viewer/s may view a plurality of communications from a microphone that remains totally or substantially stationary, or that is moved between an interviewer and interviewee, while the rotation of the accessory 3502 enables a plurality of sides and/or communications of the accessory 3502 to be viewed by the audience. Importantly, this allows the user of the microphone accessory 3502 to generate incremental revenue from the display of more than one communication to the audience of viewers.

The rotation of accessory 3502 may be achieved using a plurality of means and/or arrangements, which may include electro-mechanical systems, means and methods.

Figure 2:
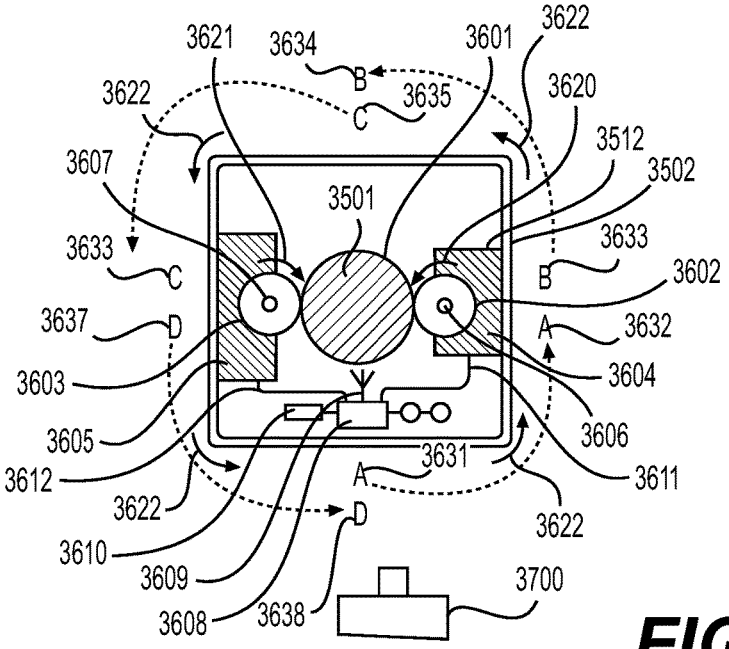
FIG. 2 illustrates a part section view through another example embodiment of the invention, in use.

As illustrated in FIG. 2, in one exemplary embodiment, microphone accessory 3502's system or arrangement 3512 may comprise the necessary components, configurations and arrangements such that microphone accessory 3502 may work in the manner contemplated herein, and may include a plurality of components, including at least one of electric motor, power source, gear, pulley, rod, sensor, drive shaft, rotation sensor, gyroscope, accelerometer, light sensor, proximity sensor, motion sensor, infrared sensor, temperature sensor, pressure sensor, wheel, solenoid, roller, o-ring, belt, geared motor, stepped motor, brush motor, stepper motor, gear pairs, hyphoid gear, ring gear, differential, spindles, bearing, wire, battery, charger, light, controller, circuitry, computer, clock, timer, hardware, software, memory, receivers, transmitter, wire, antenna and so on (in whole or in part comprising the system or configuration or arrangement 3512).

Microphone handle 3501 may be inserted through aperture or bore 3601 of microphone accessory 3502. Wheels or rollers 3602 and 3603 may frictionally engage with microphone handle 3501, such that microphone accessory 3502 remains attached to microphone handle 3501, permanently or removably. Rollers 3602 and 3603 may be attached to electric motors 3604 and 3605, respectively, using rods 3606 and 3607, respectively, which motors 3604 and 3605 may be attached to microphone accessory 3502, as illustrated. The rollers 3602, 3603 may be rubberised or comprise a suitable resilient exterior so as to aid in gripping the handle 3501, in use.

Controller 3608, which may store data and/or which may receive operational data remotely using wireless 3609 means and/or wired means, may be powered by battery 3610, which may be rechargeable, and may send at least one control signal, using wires 3611 and/or 3612 or wirelessly 3609, to motors 3604 and 3605 respectively. It will be understood that the control signal may be generated in response to an actuator being operated by a user. Such signal/s may cause motors 3604 and 3605 to rotate at a predetermined rate or desired amount or degrees, thereby causing attaching rods 3606 and 3607, respectively, to rotate, which in turn causes rollers 3602 and 3603, respectively, to rotate. For example, if roller 3602 rotates in the direction of arrow 3620, this will cause microphone flag accessory 3502 to rotate in the direction of arrows 3622, which in turn causes communication A at point 3631 to move to point 3632 and which in turn causes communication B at point 3633 to move to point 3634 and which in turn causes communication C at point 3635 to move to point 3636 and which in turn causes communication D at point 3637 to move to point 3638, and so on. Should roller 3603 rotate in the direction of arrow 3621, then the accessory 3502 will rotate in the opposite direction to that of arrows 3622. The controller may be one or more microprocessors and/or microcontrollers having an associated memory storing a set of non-transitory computer executable instructions which when executed by the controller causes the same to operate as described herein.

When accessory 3502 displays communication A at point 3631, camera 3700 may film communication A and transmit such communication to an audience of viewers which may view communication A displayed on microphone accessory 3502. When rotated as illustrated, and when accessory 3502 displays communication D at point 3638, camera 3700 may film communication D and transmit such film to an audience of viewers which may view communication D displayed on microphone flag accessory 3502, and so on.

In an alternative embodiment (not illustrated), a portion of a microphone handle, to which a conventional static microphone flag may be attached, may rotate, as desired by the user thereof, thereby causing the conventional microphone flag to rotate, instead of the microphone flag accessory 3502 causing itself to rotate about the handle of a microphone handle. The microphone 3500 or microphone handle 3501 may comprise the necessary components and/or displacement arrangements as disclosed above and/or described herein (not illustrated) to enable such rotation, as desired, of the conventional static microphone flag.

Figure 3A:
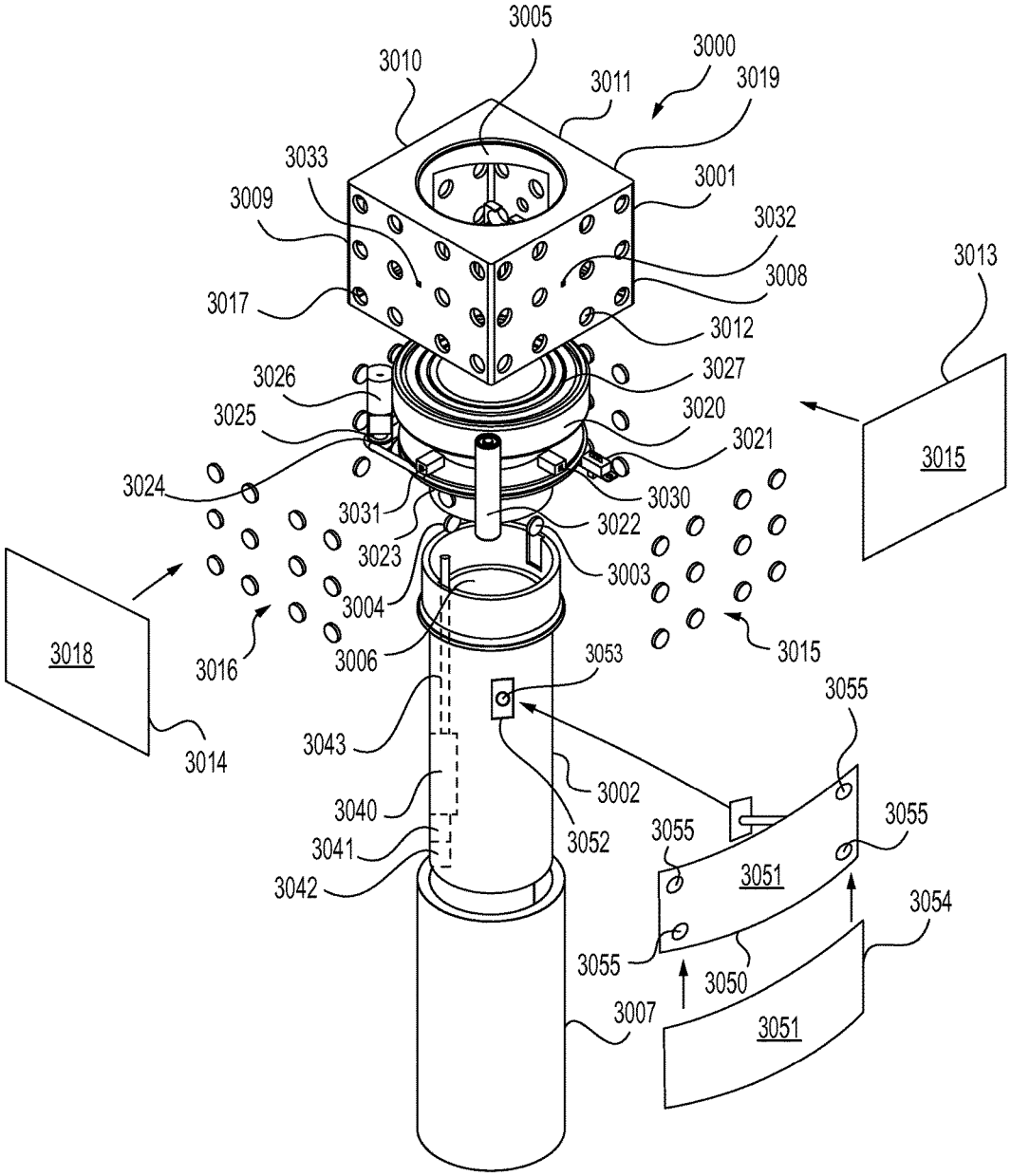
FIG. 3A illustrates an exploded perspective view of another example embodiment of the invention.

In an alternative embodiment, as illustrated in the exploded view in FIG. 3A, accessory 3000 may comprise a rotatable accessory 3001 and/or a cylindrical handle receiver portion 3002, which may be attached, permanently or removably, using at least one attachment means such as frictional engagement, magnets 3003, 3004, male-female attachment, clip on-off, dimples, and so on. A microphone (not illustrated) may be inserted into the hollow opening or bore 3005 of accessory 3001 and/or through or into hollow opening or bore 3006 of handle receiver portion 3002. In the event that the handle receiver portion 3002 is not attached to accessory 3001, then accessory 3001 may attach, using a plurality of means, such as frictional engagement, collar, clips and so on, to a microphone (not illustrated), permanently or removably. Handle receiver portion 3002 may comprise a foam cover 3007 for the comfort of the user.

Accessory 3001 may comprise a body having at least one display face 3008, or more particularly a plurality of display faces 3008, 3009, 3010 and 3011.

At least one communication may be displayed by at least one face of accessory 3001.

At least one display, display member, or display insert 3013, may be attached, permanently or removably, to at least one face 3008 of accessory 3001. At least one display or display insert 3013 may display at least one communication 3015.

A display may comprise at least one electronically variable display means for displaying at least one electronically variable communication and/or a display may comprise at least one static display for displaying at least one non-electronic non-variable static communication, such as a printed communication, which may be printed on a plurality of materials such as vinyl, paper, magnetic paper, and so on.

Side 3008 may comprise magnets 3015 (located in magnet receiving apertures 3012) and side 3009 may comprise magnets 3016 (located in magnet receiving apertures 3017), and similarly for sides 3010 and 3011 (not illustrated).

In a preferred embodiment, static display 3013 may be in the form of removable panels 3013, for example, magnetic paper panels onto which non-electronic non-variable static communication 3015 may be printed, and similarly static display 3014 may comprise magnetic paper panels onto which non-electronic non-variable static communication 3018 may be printed.

Static display 3013 and static display 3014 may be configured to substantially align with and/or to have substantially or exactly the same dimensions as that of display face 3008 and 3009, respectively.

Notably, due to the use of magnets 3015 and 3016 in sides 3008 and 3009, respectively, and the use of magnetic paper 3013 and 3014, respectively, communications 3015 and 3018 may be quickly and easily replaced, in use, while conventional microphone flags require some time to print and replace the communications on their faces. The ease and speed of replacement of communications using accessory 3001 is valuable to users of accessory 3001. Alternatively, in place of using magnets, at least one side may comprise magnetic rubber and or steel rubber and or steel paper.

Accessory 3000 may comprise a displacement arrangement comprising all the components required to make the accessory rotate about its central axis and function as disclosed herein. For example, the accessory 3000 may comprise the accessory housing 3019, which may comprise at least one side/display face or a plurality of sides/displace faces and may be comprise a plurality of shapes, such as triangular, square, oblong, and so on, and which may comprise the attaching and/or detaching systems, means and/or methods for the displays; and the displacement arrangement located in the housing 3019. The displacement arrangement may comprise the rotator 3020; battery charger 3021; battery 3022; rotator O-ring receiver 3023; O-ring 3024; pulley 3025; motor 3026; bearing 3027; switch 3028 (see FIG. 3B); circuit/controller/computer/electronics 3029 (see FIG. 3B); sensors 3030, 3031; and sensor markers 3032, 3033.

The displacement arrangement may be located on an internal frame which is attachable in a non-movable fashion, for example, conventionally with a frictional fit to the microphone handle or head, as the case may be. The rotatory coupled with the housing or body 3019 thus is rotatably displaceable around the internal frame and thus the axis of the central bore 3005, 3006, in use.

In use, the accessory housing 3019 may be attached to the rotator 3020. Battery 3022, which may be charged by battery charger 3021, may power motor 3026, which may be operatively attached to pulley 3025 by motor rod 3032 (see FIG. 3B). O-ring 3024 may be attached to and frictionally engage with pulley 3025 and to rotator 3020, which may comprise a recess into which the O-ring may be frictionally engaged. When manually switched on using actuator/switch 3028 (see FIG. 3B), the battery 3022 powers motor 3026 and controller 3029 generates an actuation or control signal (see FIG. 3B). In response to receipt of the control signal, the motor 3026 rotates causing pulley 3025 to rotate, which causes O-ring 3024 to rotate, which causes rotator 3020 to rotate, which in turn causes accessory housing or body 3019 to rotate about an axis of the bore 3005 and/or 3006, thereby causing a plurality of communications on the display faces 3008, 3009, 3010 and 3011 to be rotated and displayed, which rotation and display of the plurality of communications may be filmed, transmitted and viewed by an audience. The accessory 3000 may rotate at a selected speed or predetermined speed until manually switched off by the user actuating switch 3028.

Additionally, accessory 3000 may comprise at least one sensor 3030 or a plurality of sensors 3030, 3031 and sensor markers 3032, 3033 of different colours. In use, when a sensor, say colour detection sensor 3031 reaches sensor marker 3032, a signal may be sent to controller 3029 which may then send a signal to motor 3026 causing motor 3026 to stop for a specified duration, which in turn causes accessory housing 3019 to stop rotating. After a certain time period, controller 3029 may send a signal to motor 3026 to resume turning, and so on. To this end, the colour detection sensors 3030, 3031 may be in the form of optical detector operable to detect variation in colour between at least marker 3032 and 3033. It will be understood that in some example embodiments (not shown), the markers 3032 and 3033 may be displaceable and the sensors 3030, 3031 may be fixed but the operation thereof is substantially similar to that described above.

In one example embodiment, the accessory 3000 may rotate at a speed determined by the gearing ratio of the pulley 3025 to the rotator 3020 and/or at a speed determined by the user of the accessory 3000 at which to rotate the motor 3026, which speed of rotation may be determined and controlled by inputs to the controller 3029 (see FIG. 3*b*), whether wired or wireless, programmable or pre-programmed.

Accessory 3000 may rotate at a certain (and changeable) speed, then stop at a designated point for a desired (and changeable) period of time, then resume rotation, then stop at a designated point for a desired period of time, and so on.

Alternative systems, means and methods may be used to achieve similar or same results, such as using a stepper motor, server motor and so on.

Accessory 3000 may comprise auditing modules or components (not illustrated) to indicate when and where the accessory was used, the duration of use, speed of rotation, and so on. The data may be collected and stored locally by accessory 3000 and/or transmitted, by wire or wirelessly, to a receiver, which may receive, store and analyse the data received.

In an alternative embodiment, the components and arrangements causing the rotation of housing 3019 may be all or partly comprised in the handle 3002. For example, handle 3002 may comprise the motor 3040, battery 3041 and controller 3042, none of which may be housed with housing 3019. Rod 3043 may be attached to motor 3040 and may attach to pulley 3025. When the motor 3040 housed inside (or outside, not illustrated) handle 3002 rotates, this causes pulley 3025 to rotate, which in turn causes O-ring 3024 to rotate, which in turn causes housing 3019 to rotate.

Handle 3002 may comprise at least one attaching means 3052 for attaching thereto, permanently or removably, at least one handle display 3050. Handle display 3050 may be attached and/or detached to attaching means 3052 using a plurality of means, such as magnet 3053, velcro, male-female clips, friction, and so on.

At least one handle display 3050 may display at least one communication 3051. The handle display 3050 may comprise at least one electronically variable display means for displaying at least one electronically variable communication and/or the handle display 3050 may comprise at least one static display for displaying at least one non-electronic non-variable static communication 3054, such as a printed communication 3051, which may be printed on a plurality of materials such as vinyl, paper, magnetic paper 3054, and so on.

In a preferred embodiment, handle display 3050 may comprise magnets 3055 to which static display 3054, comprised of magnetic paper, may attach, permanently or removably. Non-electronic non-variable static communication 3051 may be printed onto static display 3054. An plurality of alternative attachment means may be used to attach static communication 3051 to handle display 3050 such as adhesive, velcro and so on. Static communication 3051 may be printed directly onto handle display 3050.

Static display 3054 and/or static communication 3051 may be configured to substantially align with and/or to have substantially or exactly the same dimensions as that of handle display 3050.

Notably, due to the use of magnets 3055 of handle display 3050 and the use of magnetic paper 3054, communication 3051 may be quickly and easily replaced, in use. The ease and speed of replacement of communication 3051 using handle display 3050 is valuable to users of accessory 3000.

Figure 3B:
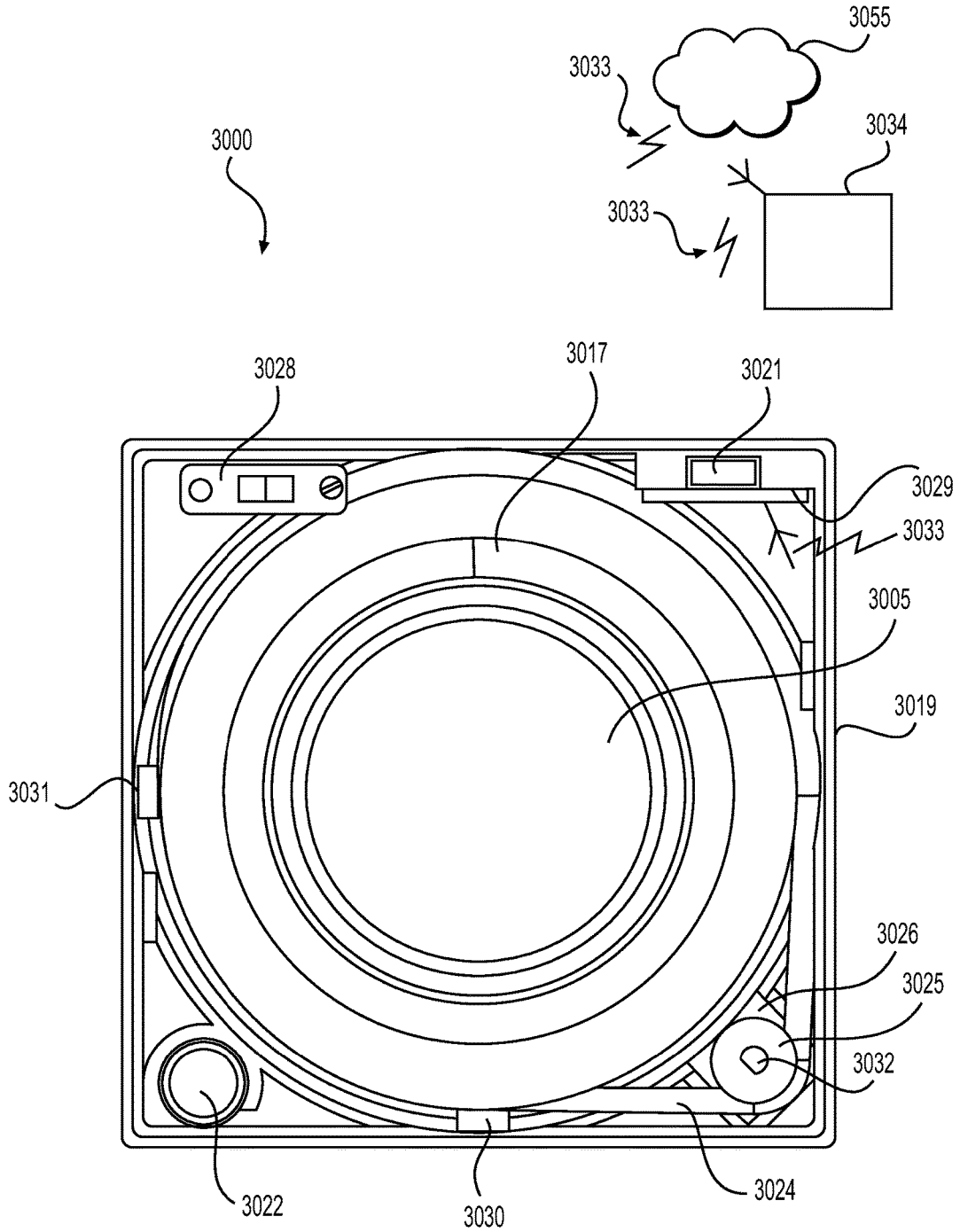
FIG. 3B illustrates a bottom view of an example embodiment of the invention.

As illustrated in FIG. 3B, accessory 3000 may be controlled by wire or wirelessly, manually and/or remotely. For example, a wireless signal 3033 may be sent from device 3034 and/or from the internet 3055 and/or from other suitable devices or systems to controller 3029 providing controller 3029 with a set of data and/or instructions such as when to start and stop, the speed of rotation, when and where and for how long to pause rotation before resuming rotation, what actions to repeat, and so on.

Figure 4:
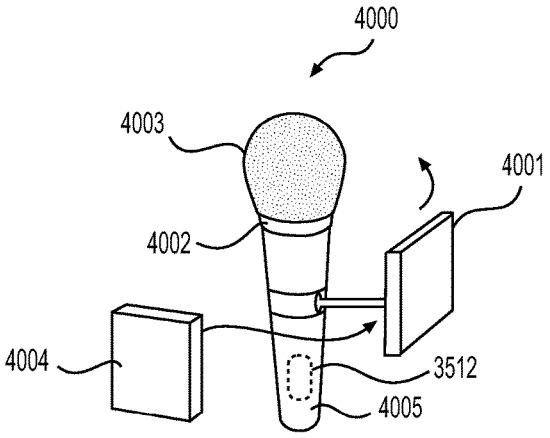
FIG. 4 illustrates a perspective view of another example embodiment of the invention.

As illustrated in FIG. 4, microphone 4000 may have attached thereto, permanently or removably, at least one accessory 4001. Arrangement 3512 may be used by microphone 4000 to rotate accessory 4001 about microphone 4000. Accessory 4001 may be attached to any part of microphone 4000, including to handle 4002 and/or to head 4003 and/or to a microphone stem, stalk, stand, arm, extender, attacher, radio holder and so on. At least one additional side 4004 or display 4004 may be attached to microphone 4000 and/or to accessory side 4001. In an alternative embodiment, microphone holder 4005 may comprise arrangement 3512 and at least one side 4001 may be attached thereto, permanently or removably. At least one additional side 4004 or display 4004 may be attached to handle 4005 and/or to side 4001.

Figure 5:
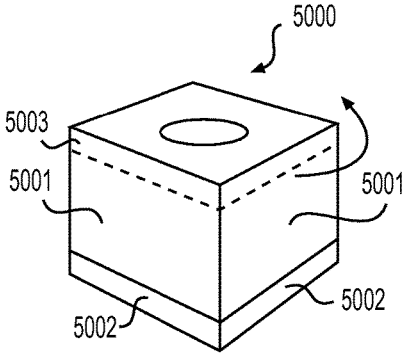
FIG. 5 illustrates a perspective view of a combined alternative embodiment of the invention.

As illustrated in FIG. 5, accessory 5000 may comprise at least one rotating body 5001 and at least one static body 5002. Static accessory 5002 may remain stationary and may display at least one communication, whether static or dynamic, while rotating accessory 5001 rotates above static accessory 5002. A static accessory, in this embodiment, may be located above a rotating accessory. In an alternative embodiment there may be at least one static accessory 5003 located above rotating accessory 5001 and at least one static accessory 5002 located below rotating accessory 5001.

Figure 6:
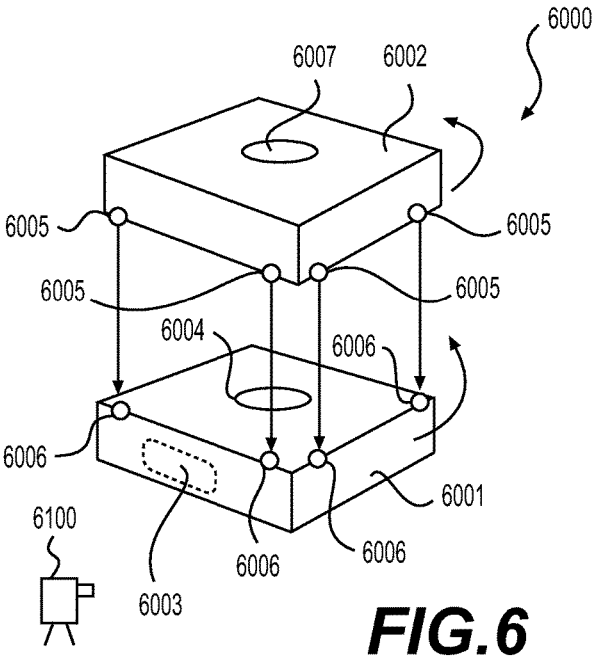
FIG. 6 illustrates a perspective view of another example embodiment of the invention.

In an alternative preferred embodiment as illustrated in FIG. 6, accessory 6000 comprises at least one electro-mechanical base or displaceable first body 6001 comprising a suitable displacement arrangement 6003 and at least one non-electro-mechanical, non-motorized, non-movable static second body 6002. The displacement arrangement 6003 of the base 6001 may comprise all the necessary components, devices for example, as disclosed or described herein, such that the base 6001 may rotate as desired by the user thereof. Base 6001 may be attached to microphone and/or microphone accessory, including to a holder, head, stem, stalk, handle, extender, stand, coupler and so on. In one embodiment, base 6001 may be attached to a microphone using hollow opening or bore 6004 as described above. The base 6001 may comprise at least one display face and may comprise at least one communication disposed thereon as described herein.

The static second body 6002, which may not be motorized and/or movable, may attach, permanently or removably, to displaceable second body 6001 so as to be rotatable by the second body 6001, in use. The second body may attach, using various attaching and/or detaching means such as adhesive, velcro, magnets, male-female attachment, and so on. For example, body 6002's magnets 6005 may attach to body 6001's magnets 6006, permanently or removably. Body 6002 may substantially align with base 6001, and body 6002's hollow opening 6007 may align with base 6001's hollow opening 6004 through which a microphone or other microphone accessory may be inserted and/or attached, permanently or removably.

Once body 6002 is attached to base 6001, the combined accessory 6000, comprising first body 6001 and the second body 6002, may be attached to a microphone. The base or the first body 6001 may be activated and start rotating, which will in turn rotate the second body 6002, and both the second body 6002 and base 6001 will rotate in synchronization with one another. As mentioned above, the body 6001 and/or body 6002 may display at least one communication. Camera 6100 may film body 6001 and/or body 6002 and/or accessory 6000 and any or all of the communications that either or both may display, whether static and/or dynamic and/or changeable, to an audience of viewers.

Figure 7:
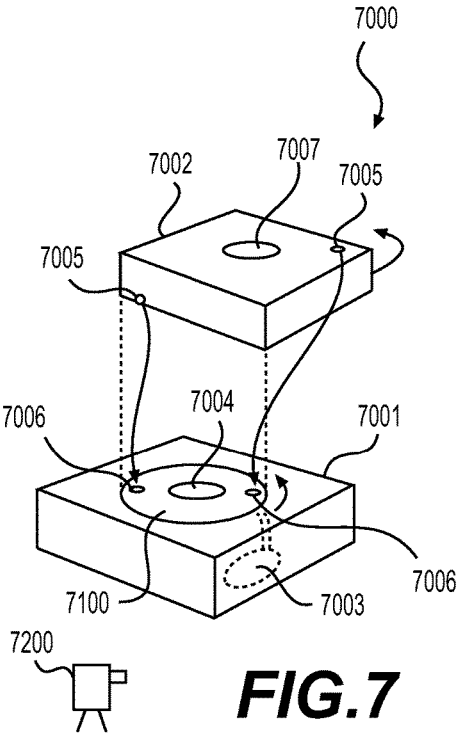
FIG. 7 illustrates a perspective view of yet another example embodiment of the invention.

In an alternative preferred embodiment as illustrated in FIG. 7, accessory 7000 comprises at least one electro-mechanical base or displaceable first body 7001 and at least one non-electro-mechanical, non-motorized, non-movable static second body 7002. Base 7001 may comprise a displacement arrangement 7003, for example, of the similar type hereinbefore described. In particular, the arrangement 7001 comprises at least one movable and/or rotatable base plate 7100 provided in the base 7001 which may rotate as desired by the user thereof. Base 7001 may be attached to a microphone and/or microphone accessory, including to a holder, stem, stalk, handle, extender, stand, coupler and so on. In one embodiment, base 7001 may be attached to a microphone using hollow opening 7004.

Second body 7002, which may not be motorized and/or movable, may attach, permanently or removably, to base 7001, particularly to rotatable plate 7100, using various attaching and/or detaching means such as adhesive, velcro, magnets, male-female attachment, and so on. For example, body 7002's magnets 7005 may attach to base 7001's magnets 7006, permanently or removably. Body 7002 may substantially align with base 7001, and body 7002's hollow opening 7007 may align with base 7001's hollow opening 7004 through which a microphone or other microphone accessory may be inserted and/or attached, permanently or removably.

Once body 7002 is attached to base 7001, the combined accessory system 7000 may be attached to a microphone, the rotatable base plate 7100 may be activated, using displacement arrangement 7003, and start rotating, which will in turn rotate body 7002. Base 7001 may remain stationary while body 7002 rotates. Base 7001 and/or accessory 7002 may display at least one communication. Camera 7200 may film base 7001 and/or body 7002 and/or accessory 7000 and any or all of the communications that either or both may display, whether static and/or dynamic and/or changeable, to an audience of viewers.

A microphone accessory may be attached to and/or coupled with, permanently or removably, a microphone's and/or a non-microphone's own handle, holder, stem, stalk, external handle, extender, stand, coupler and so on. It will be appreciated that following description, for purposes of explanation, numerous specific details are set forth in order to provide a thorough understanding of an embodiment of the present disclosure. It will be evident, however, to one skilled in the art that the present disclosure may be practiced without these specific details. In addition, it will be further appreciated by those skilled in the field of invention that variation of the specific embodiment described herein may not detract from the scope of the invention as claimed herein.

The invention claimed is:

1. A microphone accessory for use with a microphone, the microphone accessory comprising:

at least one body having at least one display face for displaying at least one communication;

an attachment formation for operatively attaching all or part of the accessory to the microphone; and a displacement arrangement selected from a group comprising an electrical, electronic, electromechanical and mechanical displacement arrangement controllable to physically displace all or part of the accessory in an automated fashion in a pre-determined or pre-selected manner relative to the microphone whilst the accessory is attached thereto so that the at least one display face is physically displaced relative to the microphone in an automated fashion upon actuation of the displacement arrangement.

2. A microphone accessory as claimed in claim 1, wherein the attachment formation is in the form of a central bore extending through the accessory, wherein one, or both, of a head portion, and handle of the microphone is receivable therein, and wherein the at least one body or the accessory is rotatably displaceable about an axis of the central bore, in use.

3. A microphone accessory as claimed in claim 1, wherein the displacement arrangement comprises:

a wired or wireless actuator; and a wired or wireless controller, wherein wired or wireless operation of the actuator causes the controller to generate a wired or wireless control signal in a predetermined or pre-selected fashion so as to cause operative displacement of the at least one body or accessory.

4. A microphone accessory as claimed in claim 2, wherein the displacement arrangement comprises:

at least one roller member mountable to the at least one body and rotatable about an axis substantially parallel to the axis of the central bore, wherein the roller member is at least partly disposed in the central bore so as to frictionally engage the head portion or handle of the microphone disposed in said central bore; and a motor operatively coupled to the at least one roller member, wherein the motor is actuable, in response to receiving a suitable control signal, to cause rotation of the at least one roller member so as to cause displacement of the accessory around the head portion or handle of the microphone, in use.

5. A microphone accessory as claimed in claim 2, wherein the accessory comprises an internal frame attachable to one, or both, of the head portion and handle of the microphone, wherein the at least one body is mountable to the internal frame and is operatively displaceable relative thereto, wherein both the at least one body and the internal frame define the central bore therethrough; and wherein the displacement arrangement is operable to displace the at least one body relative to the internal frame about the axis of the central bore.

6. A microphone accessory as claimed in claim 5, wherein the displacement arrangement comprises:

at least one rotator attachable to the at least one body, wherein the rotator shares an axis with the central bore and is operatively rotatable about said axis; and a motor operatively mountable to the internal frame and operatively coupled to the at least one rotator, wherein the motor is actuable, in response to receiving a suitable control signal, to cause rotation of the at least one rotator so as to cause displacement of the at least one body relative to the internal frame, in use.

7. A microphone accessory as claimed in claim 5, wherein the accessory comprises:

one or more additional bodies, having one or more additional display faces, wherein the one or more additional bodies are one or more of being operatively attachable to the displacement arrangement so as to be rotatably displaceable thereby, operatively attachable to the at least one body so as to be rotatably displaceable by the rotation of the at least one body, and fixedly attachable to the internal frame such that the one or more additional bodies is not displaceable, in use.

8. A microphone accessory as claimed in claim 6, wherein the internal frame comprises or is removably attachable to a handle receiver portion, wherein the handle receiver portion shares an axis with the central bore and is shaped and/or dimensioned to receive a handle of the microphone therethrough, in use.

9. A microphone accessory as claimed in claim 1, wherein the accessory comprises one or more of:

the at least one display face displaying at least one static non-electronically variable communication;

the at least one display face comprising a display screen suitable for displaying an electronically variable communication;

at least one static display removably attachable to the at least one display face, wherein the static display is configured to display at least one static non-electronically variable communication; and at least one dynamic display removably attachable to the at least one display face, the dynamic display comprising at least one display screen suitable for displaying an electronically variable communication.

10. A microphone accessory as claimed in claim 7 and claim 9, wherein the static non-electronically variable communication is selected from the group comprising printed media, two-dimensional objects, and three-dimensional object.

11. A microphone accessory as claimed in claim 1, wherein the at least one body shape may be selected from the group comprising a cuboidal shape, having four planar surfaces each defining a display face, a triangular shape having three planar surfaces each defining a display face, and an annular shape having a single curved surface defining a single curved display face.

12. A method of using a microphone, the method comprising:

locating a microphone accessory on a microphone, wherein the microphone accessory comprises at least one body having at least one display face for displaying at least one communication; and an attachment formation for operatively attaching the at least one body to the microphone; and displacing all or part of the accessory physically in pre-determined or pre-selected automated fashion relative to the microphone in response to actuation of a displacement arrangement selected from a group comprising an electrical, electronic, electromechanical, and mechanical displacement arrangement controllable to physically displace all or part of the accessory in pre-determined or pre-selected automated fashion relative to the microphone.

13. A method of using a microphone as claimed in claim 12, wherein displacing the accessory comprises controlling a displacement arrangement, by wire or wirelessly, associated with the accessory or the microphone, to displace the accessory or the at least one body.

14. A method of using a microphone as claimed in claim 13, wherein the attachment formation is in the form of a central bore through the accessory through which one, or both, of a head and a handle of a microphone is receivable, the method comprises controlling the displacement arrangement to displace the accessory or the at least one body rotatably around an axis of the central bore.

15. A method of using a microphone as claimed in claim 14, wherein the displacement arrangement comprises at least one roller member mountable to the at least one body and rotatable about an axis substantially parallel to the axis of the central bore, wherein the roller member is at least partly disposed in the central bore so as to frictionally engage the head portion or handle of the microphone disposed in said central bore; and a motor operatively coupled to the at least one roller member, wherein the motor is actuable, in response to receiving a suitable control signal, to cause rotation of the at least one roller member, the method comprising receiving a suitable control signal and controlling the motor to rotate the at least one roller member so as to displace the accessory around the head portion or handle of the microphone.

16. A method of using a microphone as claimed in claim 14, wherein the microphone accessory comprises an internal frame attachable to one, or both, of the head portion and handle of the microphone, wherein the at least one body is mountable to the internal frame and is operatively displaceable relative thereto, wherein both the at least one body and the internal frame define the central bore therethrough; wherein the method comprises controlling the displacement arrangement to displace the at least one body relative to the internal frame about the axis of the central bore.

17. A method of using a microphone as claimed in claim 12, wherein the at least one display face displays at least one static non-electronically variable communication, and/or comprises a display screen suitable for displaying an electronically variable communication; and/or wherein the accessory comprises a display removably attachable to the at least one display face, wherein the display is configured to display at least one static non-electronically variable communication, and/or the removably attachable display comprises at least one display screen suitable for displaying an electronically variable communication.

18. A microphone comprising:

a microphone head portion comprising a suitable transducer and associated circuitry; and a handle comprising a displacement arrangement engageable with a microphone accessory, at least one body having at least one display face for displaying at least one communication; and an attachment formation for operatively attaching the at least one body to the displacement arrangement of the handle, wherein the displacement arrangement is controllable to displace the at least one body of the accessory, or the accessory, automatically in a pre-determined or pre-selected manner relative to a longitudinal axis of the microphone handle, in use.

19. A microphone as claimed in claim 18, wherein the attachment formation is in the form of a central bore extending through the accessory, wherein the handle of the microphone is receivable therein, and wherein the displacement arrangement comprises:

at least one roller member mountable to the handle rotatable about an axis substantially parallel to the longitudinal axis of the handle; and a motor operatively coupled to the at least one roller member, wherein the motor is actuable, in response to receiving a suitable control signal, to cause rotation of the at least one roller member, wherein the roller member at least partly protrudes from the handle so as to engage the accessory in the central bore, in use, such that operation of the motor causes the at least one roller member to be actuated so as to frictionally engage the accessory within the central bore and cause rotational displacement of the accessory around the handle of the microphone.

20. A microphone as claimed in claim 18, wherein the attachment formation is in the form of a central bore extending through the accessory, wherein the handle of the microphone is receivable therein, wherein the accessory comprises an internal frame attachable to the handle adjacent the displacement arrangement, wherein the at least one body of the accessory is mountable to the internal frame and is operatively displaceable relative thereto, wherein the both the at least one body and the internal frame define the central bore therethrough; wherein the displacement arrangement comprises:

at least one rotator attachable to the at least one body of the accessory, wherein the rotator shares an axis with the longitudinal axis of the handle and is operatively rotatable about said longitudinal axis; and a motor and operatively coupled to the at least one rotator, wherein the motor is actuable, in response to receiving a suitable control signal, to cause rotation of the at least one rotator so as to cause displacement of the at least one body relative to the internal frame and the longitudinal axis of the microphone, in use.

* * * * *